US006817875B2

(12) United States Patent
Chang et al.

(10) Patent No.: US 6,817,875 B2
(45) Date of Patent: Nov. 16, 2004

(54) CARD EDGE CONNECTOR

(75) Inventors: Wei-Sheng Chang, Taipei (TW); Chien-Feng Chen, Taoyuan (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/353,337

(22) Filed: Jan. 29, 2003

(65) Prior Publication Data

US 2003/0148640 A1 Aug. 7, 2003

(30) Foreign Application Priority Data

Jan. 30, 2002 (TW) ..... 91200986 U

(51) Int. Cl.[7] ..... H01R 13/62

(52) U.S. Cl. ..... 439/159; 439/157; 439/327; 439/92; 439/101

(58) Field of Search ..... 439/153–159, 439/327–329, 92, 101, 630–637, 321

(56) References Cited

U.S. PATENT DOCUMENTS 5,938,463 A * 8/1999 Yodogawa ..... 439/326
5,997,332 A * 12/1999 Choy ..... 439/328
6,030,245 A * 2/2000 Choy ..... 439/328
6,135,792 A * 10/2000 Kuo ..... 439/92
6,464,514 B1 * 10/2002 Tsai et al. ..... 439/92

* cited by examiner

*Primary Examiner*—Truc T. T. Nguyen
(74) *Attorney, Agent, or Firm*—Robert J. Zeitler

(57) ABSTRACT

The invention is directed to a card edge connector. The card edge connector is electrically connected to a first circuit board for insertion of a second circuit board therein such that the second circuit board can electrically connect with the first circuit board. The second circuit board is secured within the card edge connector by means of an interference device disposed on one side of a support arm of the card edge connector. The top side of the interference device is at a height higher than the surface of the second circuit board. When the user desires to remove the second circuit board from the card edge connector, a force can be applied to the interference device to cause the two support arms to expand slightly outward, thereby permitting removal of the second circuit board and also eliminating the risk of easy breaking of free ends of the support arms associated with conventional card edge connectors.

19 Claims, 7 Drawing Sheets

PRIOR ART

CARD EDGE CONNECTOR

FIELD OF THE INVENTION

This invention relates to a card edge connector, more particularly to a card edge connector that relies on a lug of a support arm to serve as a point of application of force to sever electrical connection between an electronic card and the card edge connector.

BACKGROUND OF THE INVENTION

Initially, reference is made to FIGS. 1 and 2, which show a conventional card edge connector 6. The card edge connector 6 is electrically connected to a circuit board (not shown) for insertion of an electronic card 7 therein, such that the electronic card 7 can establish electrical connection with the circuit board. The card edge connector 6 mainly includes an insulating housing 8 having a plurality of conductive terminals 84 mounted thereon, and a pair of support members 9. The insulating housing 8 has an elongated body 81. A front side of the body 81 is formed with an elongated insert groove 82 for insertion of a connecting end 71 of the electronic card 7 therein. Two lateral walls of the insert groove 82 of the insulating housing 8 along the longer side thereof are respectively provided with a plurality of terminal receiving slots (not shown) that extend through the insulating housing 8, and that respectively receive conductive terminals 84. Each conductive terminal 84 has a contact end disposed in the insert groove 82, and a soldering end projecting outwardly of the insulating housing 8 so as to establish electrical connection with the circuit board. When the connecting end 71 of the electronic card 7 is inserted into the insert groove 82, a plurality of contacts 72 on the connecting end 71 will establish electrical connection with the contact ends of the conductive terminals 84. Two sides of the electronic card 7 are each provided with a recess 73. Two ends of the side of the insulating housing 8 provided with the insert groove 82 extend integrally and forwardly in the same direction to form respective support arms 83. Each support arm 83 has a horizontal portion 831 disposed on the inner side, and a vertical portion 832 extending vertically from the horizontal portion 831 and disposed on the outer side. An elastic extension portion 833 extends horizontally and forwardly from the vertical portion 832. The two extension portions 833 have respective lugs 834 projecting from their respective inner sides toward each other within the range of length thereof. The lugs 834 are respectively received in the corresponding recesses 73 in left and right sides of the electronic card 7 so as to secure the electronic card 7 in the card edge connector 6. Electrical connection between the electronic card 7 and the card edge connector 6 can be cut off by pulling a free end portion (the portion which is denoted by the reference numeral 838 in the FIG. and which is hereinafter referred to as the force applying portion 838 for the sake of facilitating illustration) of the extension portion 833, thereby facilitating removal of the electronic card 7 from the card edge connector 6 by the user.

The pair of support members 9 are respectively mounted on the two support arms 83, and are each formed with a press-in portion 91 by punching a malleable metal sheet for insertion into the horizontal portion 831 of the respective support arm 83, a soldering portion 92 extending horizontally from the press-in portion 91, and a limiting portion 93 extending integrally to form a substantially C-shape so as to surround and limit deviation of the respective support arm 83. The limiting portion 93 has an enlarged head end 931 that can cover the surface of the respective lug 834.

The support members 9 are disposed to limit deviation of the support arms 83. The force applying portion 838 of each support arm 83 is the point of application of force to cause the lugs 834 of the two support arms 83 to displace in a direction away from each other so as to cause the lugs 834 to disengage from the corresponding recesses 73 in the electronic card 7, thereby permitting removal of the electronic card 7 from the card edge connector 6. Therefore, the force applying portions 838 are not and cannot be surrounded by the limiting portions 93.

When the electronic card 7 is inserted into the card edge connector 6, the front end 71 of the electronic card 7 is inserted into the insert groove 82 of the insulating housing 8, the contacts 72 at the front end thereof correspondingly contact the contact ends of the plurality of conductive terminals 84 in the insert groove 82, the electronic card 7 is located between the two support arms 83, and the lugs 834 are respectively disposed in the corresponding recesses 73 at the left and right sides of the electronic card 7.

However, upon removal of the electronic card 7 from the card edge connector 6, a force has to be applied to the force applying portions 838. Since the force applying portions 838 are narrow strips, they may easily break at the lugs 834 of the support arms. Since the other parts of the support arms 83 are surrounded by the support members 9, once the force applying portions 838 break, the user cannot apply a force to the other parts of the support arms 83. Hence, the electronic card 7 cannot be removed from the card edge connector 6. Moreover, during removal of the electronic card 7 from the card edge connector 6, to exert a force on the force applying portion 838, the user's fingers must be disposed in the space cooperatively defined by the body 81 and the two support arms 83 and located in front of the electronic card 7. In other words, the support arms 83 of the card edge connector 6 must be long enough that there is a sufficient length to permit manipulation by the fingers when the electronic card 7 is disposed in the card edge connector 6. Therefore, the conventional card edge connector 6 occupies a relatively large place, which is against the current trends towards lightness, thinness, shortness and smallness of electronic devices.

OBJECTS AND SUMMARY OF THE INVENTION

One object of the present invention is to provide an edge card that effectively overcomes the drawbacks associated with the easy breaking of the force applying portions of the support arms of the conventional card edge connector.

Another object of the present invention is to provide a card edge connector to prevent breaking of support arms of an insulating housing when interference with a circuit board received therein is being removed.

Another object of the present invention is to provide a card edge connector having interference devices that are also points of application of force, that are provided on support arms, and that are integrally formed with the support arms.

A further object of the present invention is to provide a card edge connector having interference devices that are also points of application of force and that are formed from a plastic material.

Still another object of the present invention is to provide a card edge connector that has a grounding device for connecting a circuit board received therein to ground.

Still a further object of the present invention is to provide a card edge connector that has support arms with a shorter length and occupying a less amount of space.

The card edge connector of the present invention is provided with a grounding device on the support arm to connect the circuit board received therein to ground.

Accordingly, the card edge connector of the present invention is electrically connected to a first circuit board, and comprises: an insulating housing having an elongated body, the body having one face formed with an elongated insert groove for insertion of a second circuit board therein, the body being provided with a plurality of slots for receiving terminals, respectively, such that each of the terminals has a contact disposed in the insert groove, and a coupling end projecting outwardly of the insulating housing to electrically connect with the first circuit-board, each of two ends along longer sides of the body having a support arm extending therefrom, adjacent sides of the support arms being respectively provided with lugs, the second circuit board being electrically connected to the contact ends of the terminals and positioned in a first position after being inserted into the insert groove; a pair of support members respectively and detachable secured on the support arms to limit rotation of each of the support arms in an imaginary plane; when the second circuit board is positioned in the first position, each of the lugs generating interference with a depressed portion.

Furthermore, the card edge connector of the present invention may be provided with a grounding elastic plate on at least one of the support arms to connect the circuit board received therein to ground.

Moreover, the top side of each lug may project from the top side of the circuit board to thereby serve as a point of application of force.

Additionally, the lugs may be located at a distal end of the support arm.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
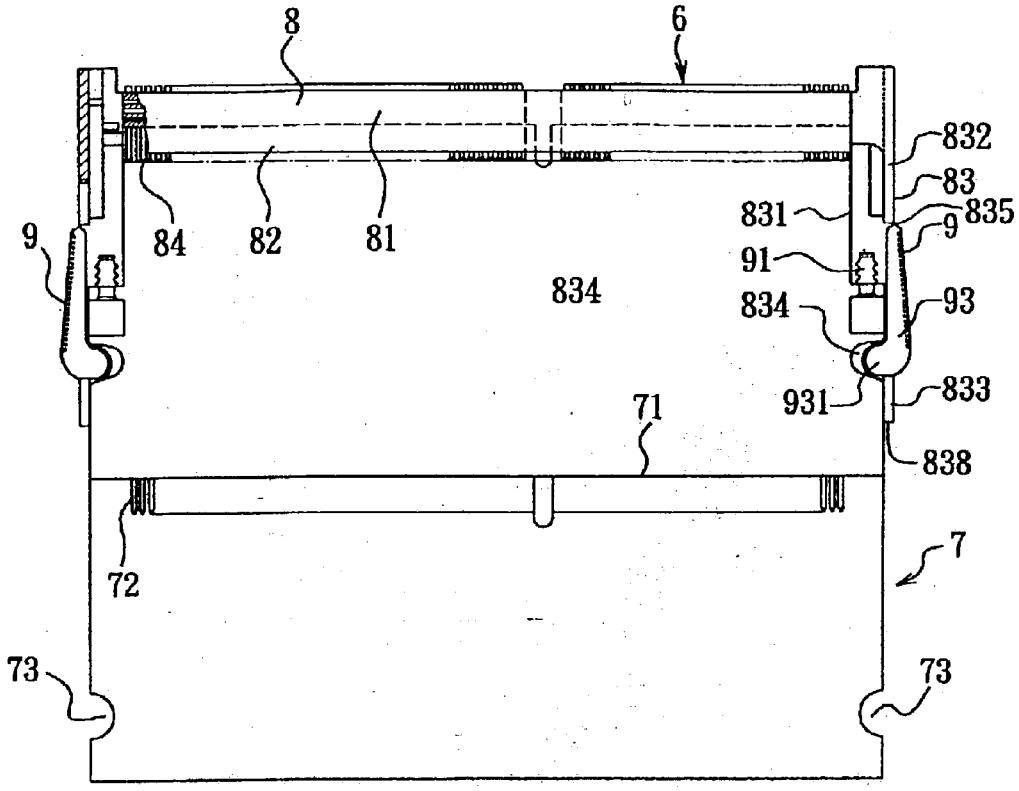
FIG. 1 is an assembled schematic view of a conventional card edge connector and a memory card.
Figure 2:
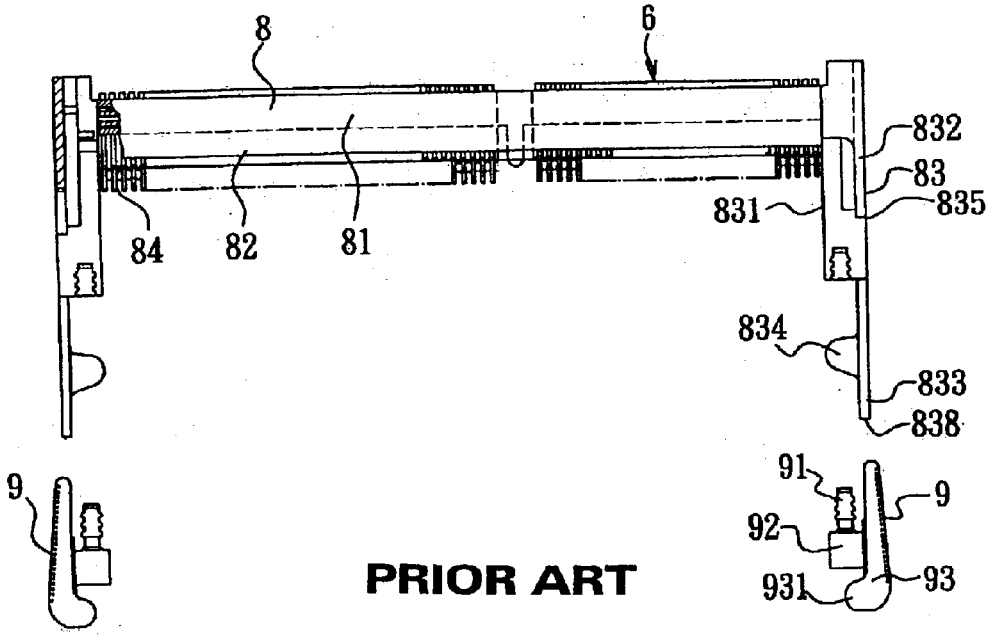
PRIOR ART FIG. 2
FIG. 2 is a schematic view of the conventional card edge connector prior to assembly of support arms of an insulating housing to support members.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 3:
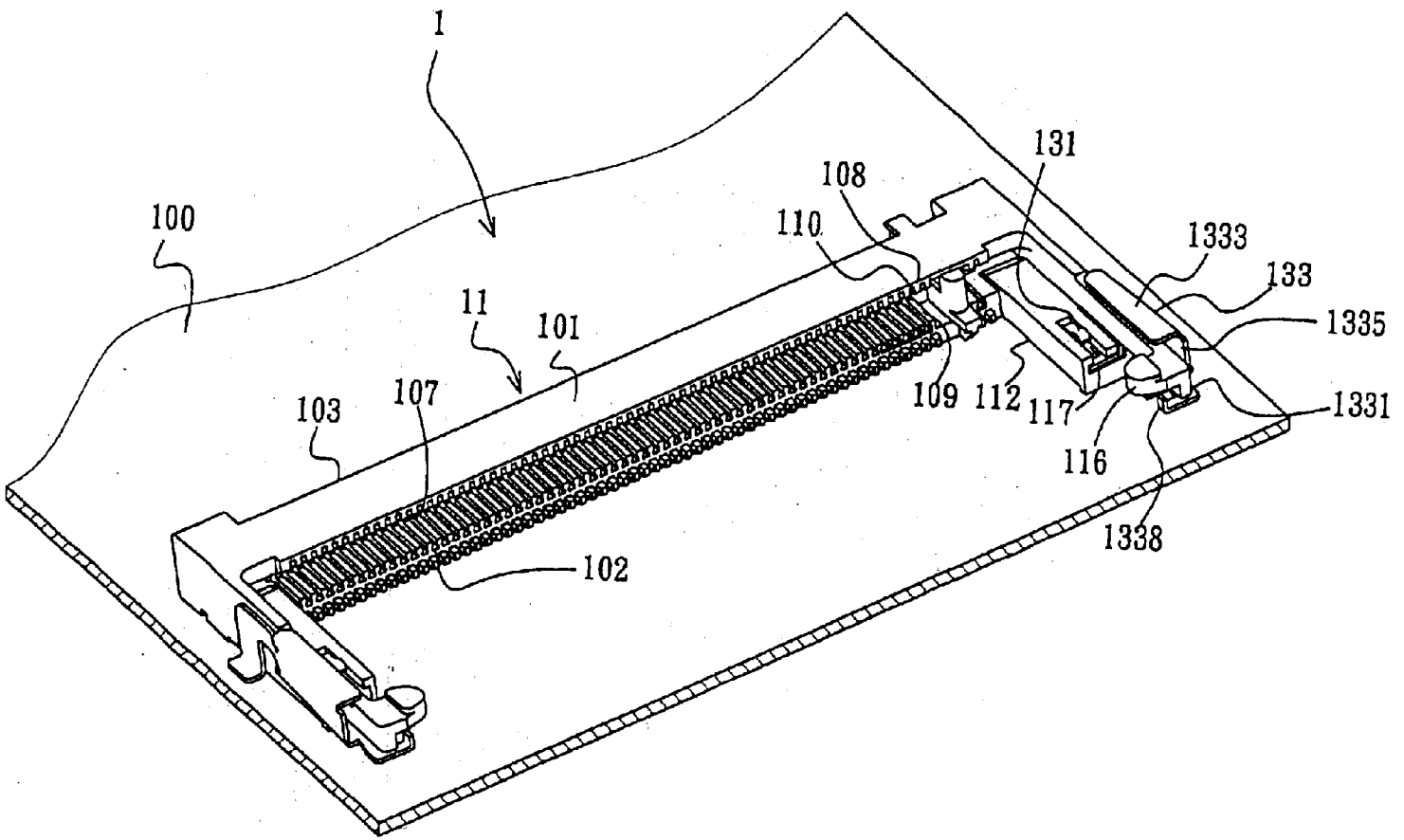
FIG. 3 is a perspective view of the first preferred embodiment of a card edge connector according to the present invention.
Figure 5:
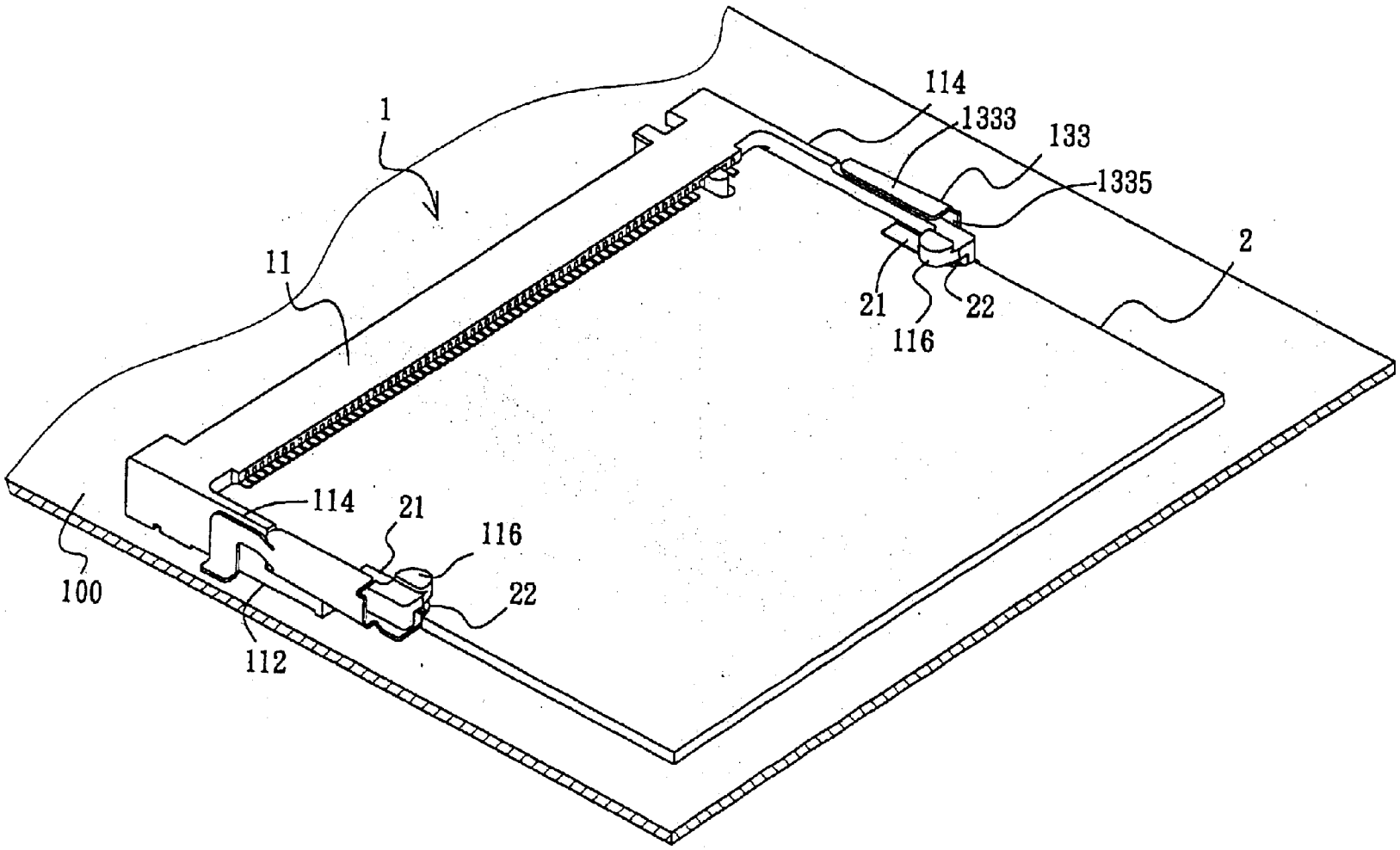
FIG. 5 is a schematic view showing coupling of the first preferred embodiment of the card edge connector according to the present invention with an electronic card.
Figure 6:
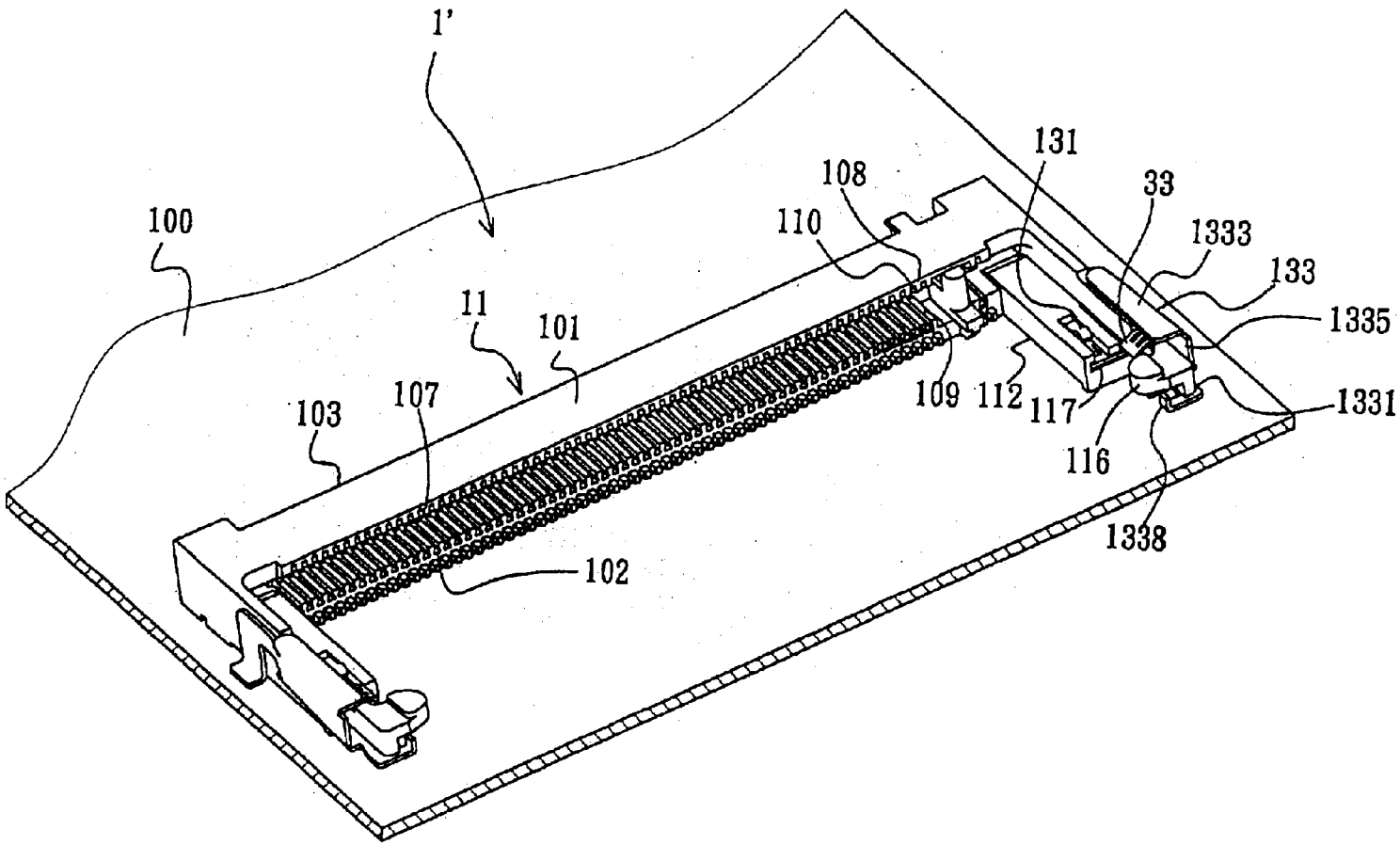
FIG. 6 is a perspective view of the second card edge connector of the second preferred embodiment.
Figure 8:
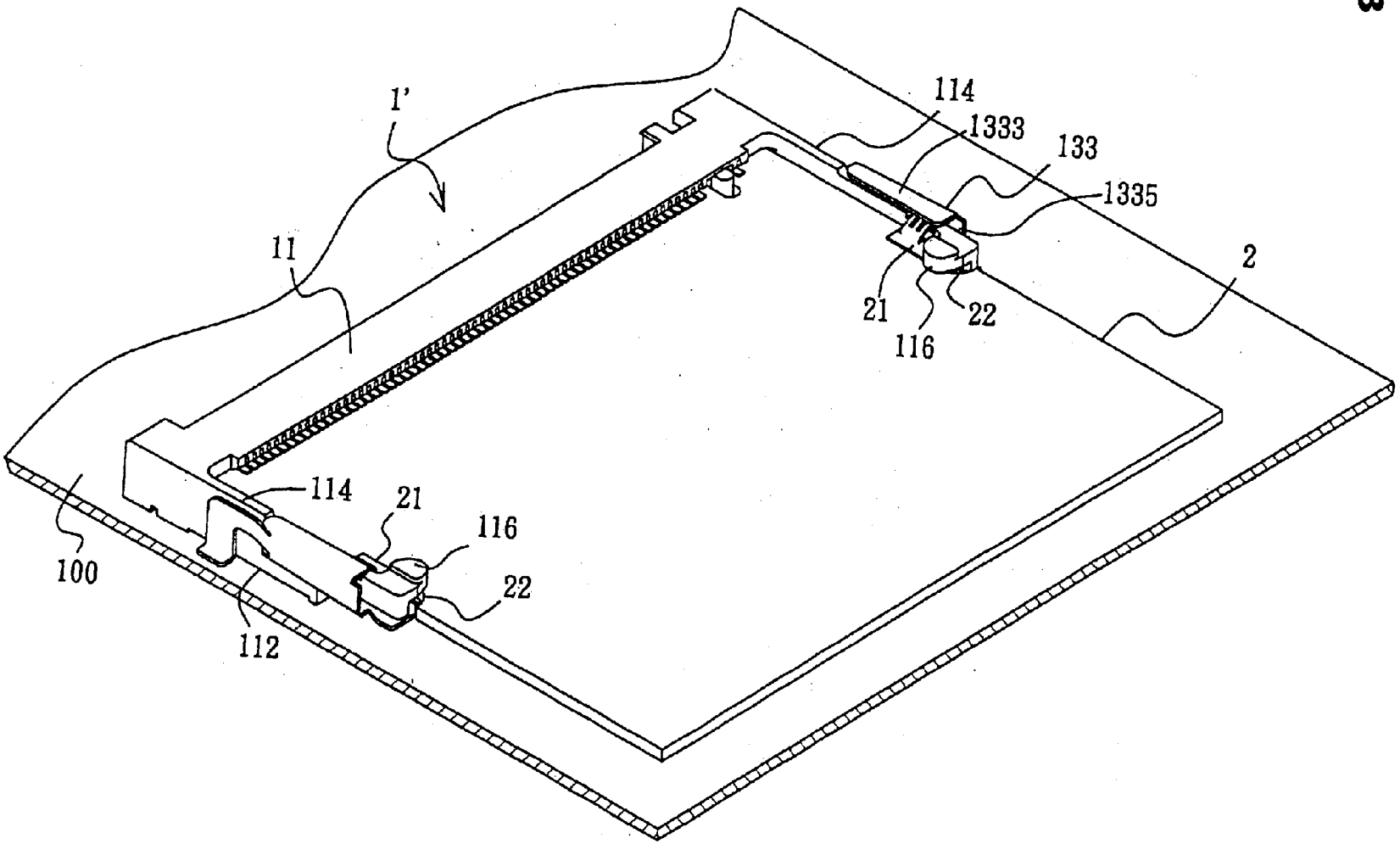
FIG. 8 is a schematic view showing coupling of the second preferred embodiment of the card edge connector according to the present invention with an electronic card.

A card edge connector 1 or 1' of the present invention is adapted to be soldered to a first circuit board 100 (as shown in FIG. 3 or 6) for insertion of a second circuit board 2 (as shown in FIG. 5 or 8) so as to enable the second circuit board 2 to electrically connect with the first circuit board 100 by means of the card edge connector 1 or 1'. In the following embodiments, the first circuit board is referred to as circuit board 100, whereas electronic card 2 represents the second circuit board.

Figure 4:
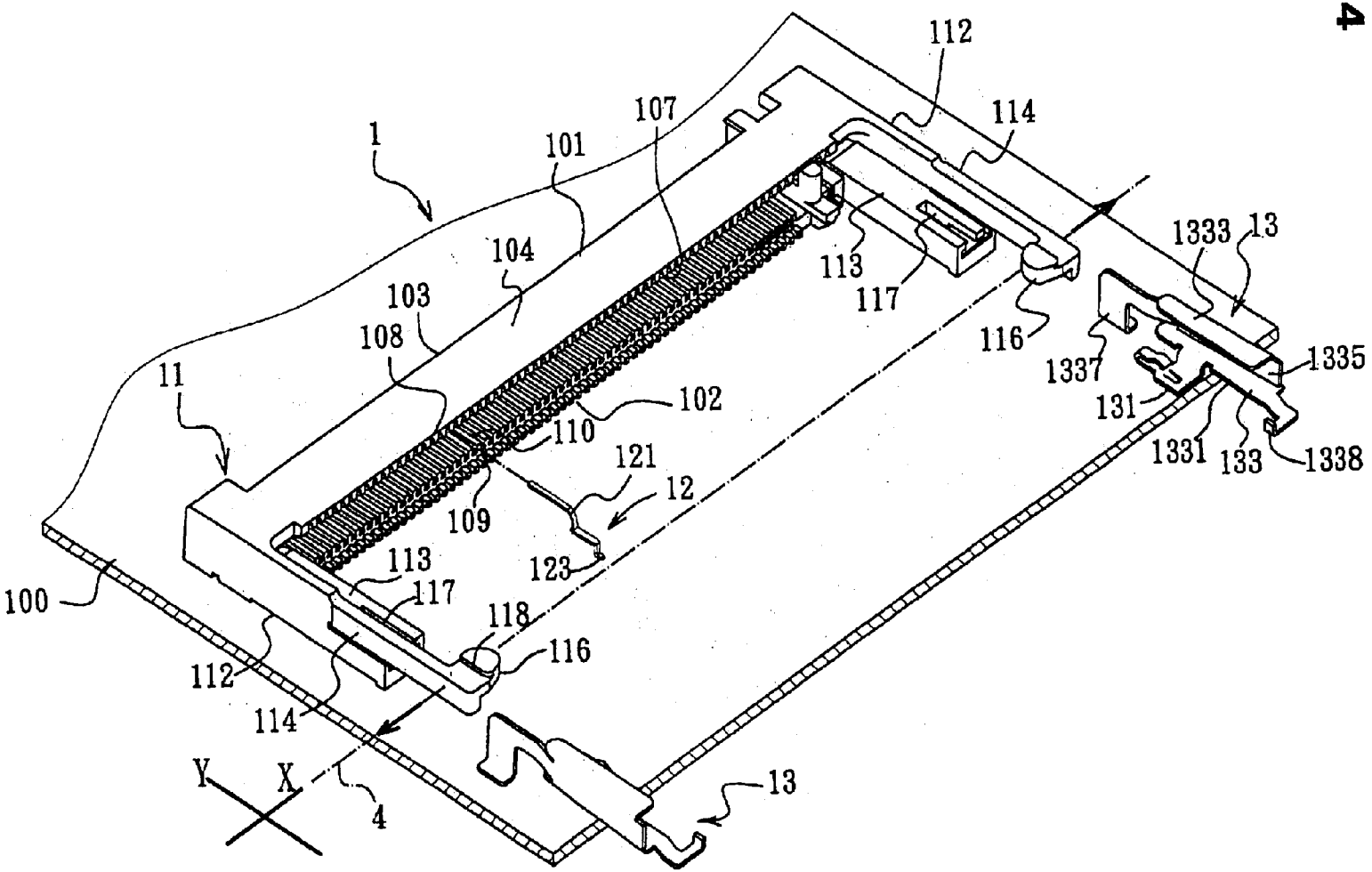
FIG. 4 is an exploded view of major components of the first preferred embodiment of the card edge connector according to the present invention, showing support members in a state prior to coupling with support arms of an insulating housing.

Firstly, reference is made to FIGS. 3 and 4, which illustrate the first preferred embodiment of the present invention. In this embodiment, the card edge connector 1 that is soldered on the circuit board 100 mainly includes an insulating housing 11, a plurality of conductive terminals 12 and a pair of support members 13. The insulating housing 11 has an elongated rectangular body 101. The rectangular body 101 has a first face 102 in the front, a second face 103 at the rear, and a top face 104. The first face 102 is formed with an insert groove 107 along a longer side thereof for insertion of a connecting end of the electronic card 2. The insert groove 107 of the insulating body 11 has an upper side wall 108 and a lower side wall 109 which are provided with a plurality of slots 110 that extend from the first face 102 to the second face 103. Each slot 110 receives a respective one of the conductive terminals 12. The conductive terminals 12 have contact ends 121 disposed in the insert groove 107 to electrically contact a plurality of contacts of a connecting end of the electronic card 2 which are inserted in the insert groove 107. The coupling ends 123 of the conductive terminals 12 extend outwardly of the body 101 from the second face 103 to thereby electrically connect with the plurality of contacts of the circuit board. The electrical connection between the coupling ends 123 of the conductive terminals 12 and the contacts on the circuit board can be established in any conventional manner, e.g., surface mounting technique (SMT), passing the coupling ends 123 through through-holes in the circuit board for subsequent furnace reflow and soldering, etc.

The two ends of the insulating housing 11 along the longer side thereof respectively have support arms 112 projecting forwardly and integrally therefrom. Each support arm 112 has a horizontal portion 113 and a vertical portion 114 extending uprightly from the outer side of the horizontal portion 113, an interference device 116 being provided to project horizontally from a front end of the upright portion 114 toward the other one of the support arms 112. In this embodiment and the following embodiments, the interference device 116 is a lug that is received in a respective one of recesses 21 in the left and right sides of the electronic card 2 so as to generate interference with the electronic card 2. The lug 116 is higher than the surface of the upright portion 114 of the support arm 112, and forms a shoulder 118 with the surface of the upright portion 114. The condition of the height of the lugs 116 is such that when the electronic card 2 is positioned in the card edge connector 1, the lugs 116 must protrude from the surface of the electronic card 2, which will be explained in the succeeding paragraphs. Each horizontal portion 113 has an open card slot 117 extending from the front to the rear. The card slot 117 has a cross section that is substantially T-shaped, and has an upper smaller opening and a lower larger cavity. The horizontal portion 113 extends forwardly for a length that is smaller than the length of the upright portion 114 that extends forwardly.

The pair of support members 13 is formed by punching and bending metal sheets. Each support member 13 includes a press-in portion 131 that is insertable into the card slot 117 in the respective support arm 112, and a limiting portion 133 that extends from the outer side of the press-in portion 131 to form a substantially U-shape so as to surround the upright portion 114 of the respective support arm 112. The U-shaped limiting portion 133 includes a transversely extending lower first transverse portion 1331, a transversely extending upper second transverse portion 1333, and an upright connecting portion 1335 interconnecting the two transverse portions. The upright connecting portion 1335 further extends rearwardly to form a securing portion 1337. The securing portion 1337 can be disposed on the first circuit board 100 by soldering so as to secure the support members 13 to the first circuit board 100 and for grounding purposes, depending on requirements. The lower first transverse portion 1331 further extends transversely and forwardly toward the other one of the support arms 112 to form a retaining hook 1338 having an L-shaped body and an upwardly oriented end portion.

With particular reference to FIG. 3, when mounting the support members 13 on the respective support arms 112, the press-in portions 131 are inserted into the card slots 117 of the respective support arms 112, while the limiting portions 133 surround the bottom, top and outer sides of the respective support arms 112. At this time, the first transverse portion 1331 is below the bottom side of the respective support arm 112; the second transverse portion 1333 is on top of the respective support arm 112; and the upright connecting portion 1335 is at the outer side of the respective support arm 112 and maintains a predetermined clearance with the support arm 112, the function of which is to be described hereinafter. The securing portion 1337 which extends rearwardly from the upright connecting portion 1335 and which is disposed at the outer side of the respective support arm 112 can be soldered to the circuit board by using any conventional method, and can as well serve as grounding means depending on requirements. The L-shaped retaining hook 1338 is disposed at the inner side of the respective support arm 112 and maintains a predetermined distance with the support arm 112 such that improper manipulation of the support arm 112 when the electronic card 2 is not mounted in the card edge connector 1, which may cause them to approach each other to entail the danger of breaking, can be avoided. This is one of the safety measures provided by the present invention.

Generally, the left and right sides of the electronic card 2 respectively have depressed portions 22. With further reference to FIG. 5, if it is desired to position the electronic card 2 in the card edge connector 1, firstly, the electronic card 2 has to be disposed slantingly so that the connecting end thereof is inserted into the insert groove 107. Then, the electronic card 2 is pressed downwardly to be thereby positioned in the card edge connector 1. At this time, the lug 116 of each support arm 112 is disposed in the depressed portion 22 in the corresponding side of the electronic card 2 to keep the electronic card 2 in electrical connection with the card edge connector 1 constantly, and the lug 116 projects from the surface of the electronic card 2. When it is desired to remove the electronic card 2 from the card edge connector 1, the user takes the two lugs 116 as the points of application of force and exerts a force so that each support arm 112 rotates in an imaginary plane 4. Since the limiting portion 133 surrounding the support arm 112 maintains a predetermined clearance with the support arm 112, the free end of the support arm 112 is permitted to displace away therefrom to a limited extent. However, if the force exerted by the user is excessive, the limiting portion 133 will limit the displacement of the support arm 112 to ensure that the support arm 112 will not break. Since the support arm 112 rotates in an imaginary plane 4, the lug 116 on the support arm 112 can withdraw from the depressed portion 22, thereby relieving the electronic card 2 of the interference brought about by the lug 116. Hence, the user can remove the electronic card 2.

The card edge connector 1 of this invention utilizes the lugs 116 as the points of application of force for relieving the interference on the electronic card 2. Since the lugs 116 have a relatively large area, the strength will be relatively strong. Therefore, there will not be the danger of breaking as in the prior art.

In addition, since the card edge connector 1 of this invention utilizes the lugs 116 as the points of application of force for relieving the interference on the electronic card 2, the user manipulates the lugs 116 from above the transversely lying electronic card 2. Therefore, the support arms 112 of the card edge connector 1 do not need to have an additional length for accommodating fingers for manipulation as in the prior art. Therefore, the length of the support arms 112 can be shorter as compared with the prior art to thereby reduce the area utilized. This is good news to the already very crowded circuit board 100.

Figure 7:
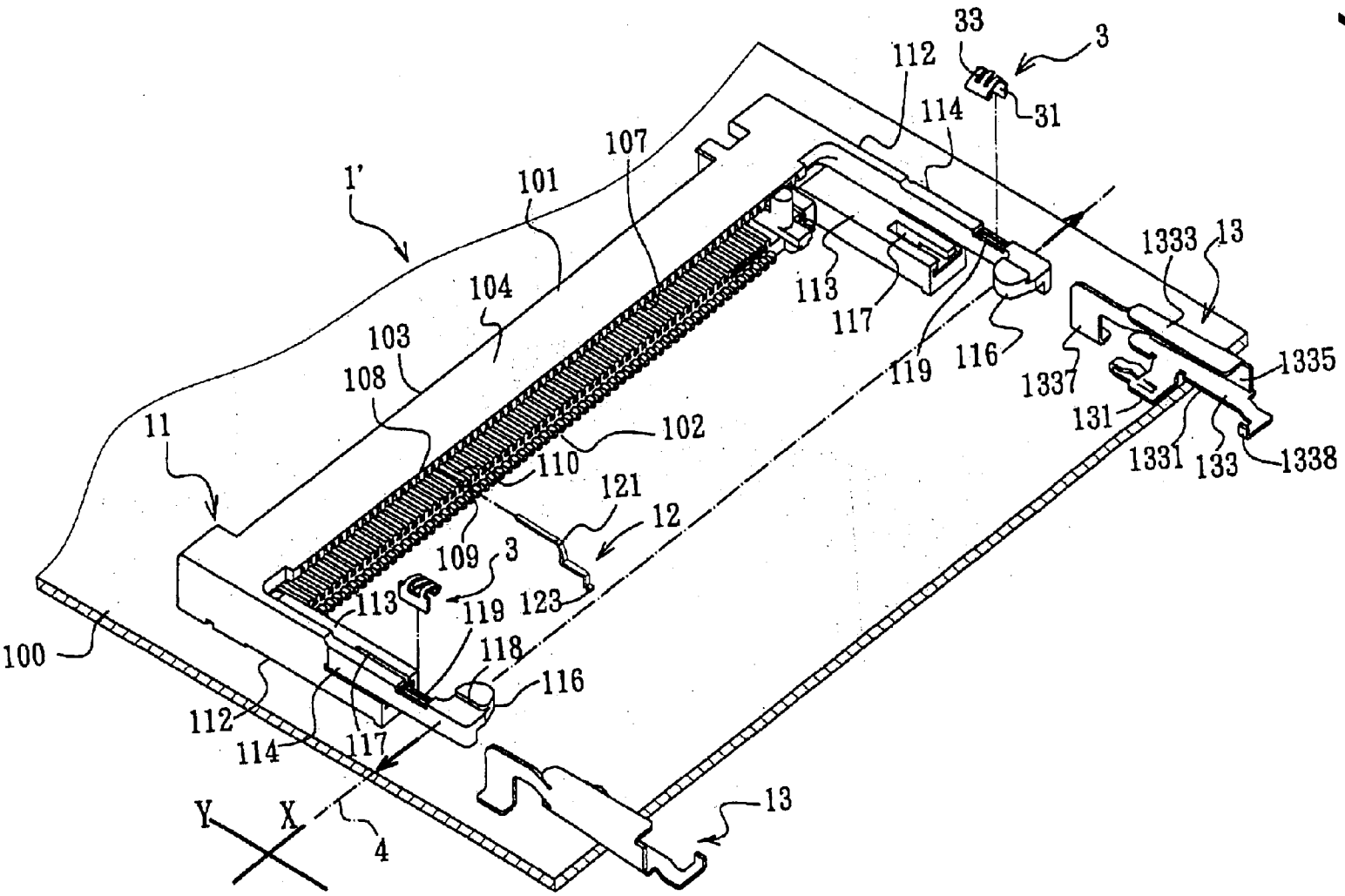
FIG. 7 is an exploded view of major components of the second preferred embodiment of the card edge connector according to the present invention, showing support members and elastic plates thereof in a state prior to coupling with support arms of an insulating housing.

As shown in FIGS. 6, 7 and 8, which show the second preferred embodiment, in this embodiment, the difference between the card edge connector 1' and the card edge connector 1 of the first preferred embodiment resides in the addition of a pair of grounding elastic plates 3 to serve as grounding means of the electronic card 2. Furthermore, for mounting the elastic plates 3, the top side of each support arm 112 is formed with a narrow groove 119 extending through the support arm 112. The following description will be devoted to the difference therebetween. Structural elements that are identical to those in the first preferred embodiment are still represented by the same reference numerals. The elastic plates 3 are metallic plates that are formed by stamping, each having a press-in portion 31 and an abutting portion 33. The abutting portion 33 and the press-in portion 31 are subjected to at least one bending operation so that they do not lie in the same plane. The press-in portion 31 can be inserted downwardly into the narrow groove 119 through the top side of the support arm 112 to dispose the abutting portion 33 at the inner side of the respective support arm 112. When the support members 13 are assembled to the respective support arms 112, each of the elastic plate 3 is located between the top side of the respective support arm 112 and the respective second transverse portions 1333, with a free end of the press-in portion 33 of the elastic plate 3 contacting the respective first transverse portion 1331 below, while the abutting portion 33 of the elastic plate 3 is disposed at the inner side of the respective support arm. When the electronic card 2 enters into the card edge connector 1, the abutting portion 33 will not obstruct entry of the electronic card 2 due to its elasticity. When the electronic card 2 is positioned in the card edge connector 1, the abutting portion 33 of the elastic plate 3 will abut against the surface of the electronic card 2 to thereby establish grounding. Since the other aspects of the construction of the card edge connector are not changed, a detailed description thereof is dispensed with herein for the sake of brevity.

While a preferred embodiment of the present invention is shown and described, it is envisioned that those skilled in the art may devise various modifications of the present invention without departing from the spirit and scope of the appended claims.

What is claimed is:

1. A card edge connector adapted to establish electrical connection between a first circuit board and a second circuit board, two opposite sides of the second circuit board respectively having depressed portions, said card edge connector comprising:

an insulating housing having an elongated body, said body having a first face, which is formed with an insert groove along a longer side thereof for insertion of the second circuit board, said body being formed with a plurality of slots that respectively extend through said body, two ends of said first face of said body along the longer side thereof respectively having support arms projecting therefrom, said support arms each having one side disposed proximate to each other and provided with a lug projecting integrally therefrom at a distal end of said support arm;

a plurality of terminals respectively disposed in said slots, each of said terminals having a contact end disposed in said insert groove for establishing electrical contact with a contact of the second circuit board that is inserted into said insert groove, and a coupling end projecting outwardly of said housing so as to be electrically connected to a contact of the first circuit board;

a pair of metal support members which are respectively and detachably secured on said support arms so as to limit rotation of each of the said support arms in an imaginary plane;

when the second circuit board is positioned in said card edge connector, each of said lugs generating interference with a corresponding one of the depressed portions.

2. The card edge connector as claimed in claim 1, wherein a top side of each of said lugs projects from the surface of the second circuit board.

3. The card edge connector as claimed in claim 1, wherein each of said support arms has a horizontal portion and a vertical portion extending uprightly from an outer side of said horizontal portion, each of said lugs being provided on a free end of said vertical portion and projecting from the surface of the respective one of said support arms.

4. The card edge connector as claimed in claim 1, wherein said support members are formed by punching and bending metallic sheets, each of said support members including a press-in portion for insertion into said horizontal portion of a respective one of said support arms, a limiting portion extending from an outer side of said press-in portion to form a substantially U-shaped so as to surround said upright portion of the respective one of said support arms.

5. The card edge connector as claimed in claim 4, wherein said U-shaped limiting portion includes a transversely extending lower first transverse portion, a transversely extending upper second transverse portion, and an upright connecting portion interconnecting said transverse portions.

6. The card edge connector as claimed in claim 4, wherein said limiting portion further extends in the direction of said body to form a securing portion for grounding with the first circuit board.

7. The card edge connector as claimed in claim 5, wherein said upright connecting portion further extends in the direction of said body to form a securing portion for grounding with the first circuit board.

8. The card edge connector as claimed in claim 3, wherein said horizontal portion of each of said support arms has an open card slot extending in the direction of said body, said card slot having a cross section that resembles a T-shape, and an upper smaller opening and a lower larger cavity.

9. The card edge connector as claimed in claim 3, wherein said horizontal portion has a length smaller than that of said upright portion.

10. The card edge connector as claimed in claim 5, wherein said first transverse portion further extends transversely in a direction away from said body and toward the other one of said support arms to form a card hook having an L-shaped body and an upwardly oriented end portion.

11. The card edge connector as claimed in claim 1, wherein at least one of said support arms is formed with a narrow groove that extends therethrough for mounting a grounding elastic plate therein so as to serve as grounding for the second circuit board that is positioned in said card edge connector.

12. The card edge connector as claimed in claim 11, wherein said elastic plate is formed by punching a metal sheet, and has a press-in portion and an abutting portion, said abutting portion and said press-in portion not lying in a same plane, said press-in portion being inserted into said narrow groove to enable said abutting portion to be disposed at an inner side of said one of said support arms.

13. The card edge connector as claimed in claim 12, wherein said elastic plate is disposed between the top side of said support arm and said second transverse portion.

14. A card edge connector adapted to establish electrical connection between a first circuit board and a second circuit board, said card edge connector comprising:

an insulating housing having an elongated body, one face of said body which is along a longer side thereof being formed with an insert groove for insertion of one end of the second circuit board thereinto, said body being formed with a plurality of slots extending through a shorter side of said body, two ends of said body along the longer side thereof projecting in the same direction to form respective support arms;

a plurality of terminals respectively disposed in said slots and having contact ends inserted into said insert groove to electrically contact the second circuit board, and coupling ends to be electrically connected to the first circuit board;

a pair of metal support members which are respectively and detachably secured on said support arms to limit rotation of each of said support arms in an imaginary plane;

a pair of interference devices which are formed from an insulating material and which are respectively and integrally formed on adjacent sides of said support arms such that when the second circuit board is positioned in said card edge connector, each of said interference devices generating interference with the second circuit board and serving as a point of application of an external force to relieve the second circuit board of the interference.

15. The card edge connector as claimed in claim 14, wherein at least one of said support arms is formed with a narrow groove that extends therethrough for mounting a grounding elastic plate therein so as to serve as grounding for the second circuit board that is positioned in said card edge connector.

16. The card edge connector as claimed in claim 15, wherein said elastic plate is formed by punching a metal sheet, and has a press-in portion and an abutting portion, said abutting portion and said press-in portion not lying in a same plane, said press-in portion being inserted into said narrow groove to enable said abutting portion to be disposed at an inner side of said one of said support arms.

17. The card edge connector as claimed in claim 16, wherein said elastic plate is disposed between the top side of said support arm and said second transverse portion, said elastic plate being formed by punching a metal sheet and having a press-in portion and an abutting portion, said abutting portion and said press-in portion not lying in a same plane, said press-in portion having a free end contacting said first transverse portion, said abutting portion being disposed at an inner side of said support arm.

18. A card edge connector adapted to establish electrical connection between a first circuit board and a second circuit board, two opposite sides of the second circuit board respectively having depressed portions, said card edge connector comprising:

an insulating housing having an elongated body, one face of a longer side of said body being formed with an insert groove for insertion of the second circuit board, said body being formed with a plurality of slots extending through a shorter side of said body, two ends of the longer side of said body having support arms projecting therefrom in the same direction;

a plurality of terminals respectively disposed in said slots, each of said terminals having a contact end disposed to electrically contact an end of the second circuit board that is inserted into said insert groove; and a coupling end disposed to electrically connect with the first circuit board;

a pair of metal support members which are respectively and detachably secured on said support arms so as to limit rotation of each of said support arms in an imaginary plane; and a pair of interference devices which are respectively and integrally formed on adjacent sides of said support arms such that when the second circuit board is positioned in said card edge connector, each of said interference devices generating interference with a respective one of the depressed portions of the second circuit board, a force being exertable directly on each of said interference devices to relieve the second circuit board of the interference, each of said interference devices projecting from the surface of the respective one of said support arms on which it is formed.

19. The card edge connector as claimed in claim 18, wherein at least one of said support arms includes a grounding elastic plate extending therefrom to serve as grounding for the second circuit board that is positioned in said card edge connector.

* * * * *